US005860705A

United States Patent [19]

Ridder

[11] Patent Number: 5,860,705

[45] Date of Patent: Jan. 19, 1999

[54] CHAIR OR ARMCHAIR

[76] Inventor: Everwijn Petrus Maria Ridder, Waltmanstraat 85, 2136 BB Zwaanshoek, Netherlands

[21] Appl. No.: 843,923

[22] Filed: Apr. 17, 1997

[51] Int. Cl.[6] ..... A47C 7/00

[52] U.S. Cl. ..... 297/452.41; 5/655.5; 297/284.1; 297/284.6

[58] Field of Search ..... 297/284.1, 284.2, 297/284.6, 452.41; 5/655.5

[56] References Cited

U.S. PATENT DOCUMENTS

| | | | |
|---|---|---|---|
| 697,279 | 4/1902 | Schmied | 297/180.15 X |
| 3,499,682 | 3/1970 | Orenstein | 297/452.41 |
| 4,143,909 | 3/1979 | McFarlin | 297/284.1 |
| 4,738,486 | 4/1988 | Surber | 297/180.15 X |
| 4,761,011 | 8/1988 | Sereboff | 297/452.41 |
| 4,929,026 | 5/1990 | Barbelet | 297/452.41 |

FOREIGN PATENT DOCUMENTS

| | | | |
|---|---|---|---|
| 2448810 | 4/1975 | Germany | 297/452.41 |

*Primary Examiner*—Peter R. Brown
*Attorney, Agent, or Firm*—Foley & Lardner

[57] ABSTRACT

Chair or armchair, its seat (1) and back (2) being provided with a covering (3, 6; 7, 10) of a resilient material such as foam rubber or a similar material. Both the seat (1) and the back (2) contain a cushion (5, 9) filled with water or a similar material, with a thickness between 20 and 80 mm when in filled condition. The internal spaces of the cushions (5, 9) are connected to each other. The cushions form an integral unity (11) and at the point where the cushion (5) for the seat (1) connects to the cushion (9) for the back (2), a partition has been mounted, which is obtained in that the integral cushion (11) is provided with an elongated slot (12) extending in transverse direction, or in that it is pressed by one or more rollers (15, 16).

6 Claims, 3 Drawing Sheets

CHAIR OR ARMCHAIR

The invention relates to a chair or armchair, its seat and back being provided with a covering of a resilient material such as foam rubber or a similar material.

Hereinafter, for the sake of simplicity, we will speak of a chair, but this is also understood to mean an armchair.

Although a known chair provided with a covering of foam rubber can be fairly comfortable to sit in, practice has shown that in many cases this only holds for certain persons. The figure, the desire sitting position and the further physical condition differs from person to person and said resilient material is not able to sufficiently adapt to that.

Namely, if a layer of said resilient material will be depressed more on a certain spot than on another spot, the counter pressure of the material will be higher on the first-mentioned spot. The pressures exerted on the body parts of a person sitting in the chair will thus vary from place to place. It has been shown that this damages the sitting comfort.

The object of the invention is to improve the sitting comfort and that in such a way, that the seat and the back can adapt more easily to the person and his sitting position without this resulting in locally considerably higher pressures on the body of the user.

According to the invention this is achieved, in that both the seat and the back contain a cushion filled with water or a similar, non-compressible material, with a thickness between 20 and 80 mm when in filled condition, the internal spaces of the cushion in the seat and of the cushion in the back being connected to each other by connecting means having a free cross-section, that is, a cross-section of the channel or channels through which water can flow from the cushion in the seat into the cushion in the back or vice versa, the cross-section being smaller than the cross-section of the parts of the cushion connecting to the channel or channels.

Although one will use water in particular, since it is easily available, a disadvantage thereof is the possibility that algal growth can arise and that oxygen can be released from the water. In connection to that, one can also use a gel or a similar non-compressible material.

When a chair according to the invention is not occupied, relatively speaking, there will be more water in the cushion in the seat than in the cushion in the back, since the latter extends upward. When a person sits down in the chair, water from the cushion in the seat will be pushed into the cushion in the back. Due to the fact that the water must flow through the connecting means having the limited cross-section, the flow of water from the cushion in the seat is delayed. This prevents a relatively large amount of water from being pushed from the cushion in the seat before the person contacts the back. In this way, a certain balance is reached in the pressure in both cushions and thus in the pressures being exerted on the body of the person sitting in the chair. Further, it will be obvious that the pressure on the person's body parts contacting the chair is largely equal everwhere. This attributes to the sitting comfort. Also when changing position, the restriction in the connecting means will provide for that no sudden displacement of water from one cushion to the other will occur. Naturally, an easy displacement of water can occur within a cushion.

It is obvious, that the occurence of a uniform pressure across the body is also achieved with the use of the known water beds. However, here the body is in an almost horizontal position and there is no or substantially no difference in the level of the water in several places.

Principally, there is the possibility of connecting the cushions in the seat and in the back to each other by application of a number of small hoses. However, it has appeared that this makes production of such cushions expensive, while there is a certain risk that a connection between a cushion and a hose will break. Obviously, this can result in big problems.

According to a first embodiment of the invention it is provided for, that both cushions form an integral unity and that at the point where the cushion for the seat connects to the cushion for the back, a partition between the internal spaces of both cushions has been mounted in the central portion of the integral cushion.

Thus, on both sides of this partition there is a connection between both cushions, on account of which the effect described above is achieved, namely, that the water can not flow freely from one cushion into the other.

Such a partition can be obtained in particular in that the integral cushion is provided with an elongated slot extending in transverse direction up to a distance from both side edges of the cushion, said slot being closed along the edge.

This entails the advantage, that both cushions can easily enclose an angle, as is desired when they are situated in a seat and a back of a chair.

The length of the slot will be between 25 and 75% of the total width of the cushion, seen in longitudinal direction of the slot. In particular, the length of the slot will be between 30 and 65% of the width of the cushion.

By applying an elongated slot between both cushions, the risk of cracks arising will be enhanced.

In connection to this, according to another development of the invention it can be provided for, that both cushions form an integral unity and that at least one pressing member has been mounted between both cushions, by which the cushion will be pressed against a part of the chair and a connecting channel with limited passage is obtained between both cushions.

According to a development of the invention, one can employ two pressing members at some distance from each other and extending on both sides of the cushions, said distance being smaller than the thickness of the cushions in the water-filled condition.

Then, the pressing members can be formed in such a way, that their surfaces abutting the cushions have a convex shape. Owing to this, the risk of wear of the cushions will be reduced. For example, the pressing members can be in the form of rollers.

According to a further development, the rollers can be supported in such a way, that the distance between the rollers is adjustable. Then, the cushions can be adjusted to the weight and the wishes of the user.

For optimal sitting comfort, it has proven to be advantageous, that the cushions are received between layers of resilient material such as foam rubber or like material, which is also used in known chairs. The foam rubber also provides for protection of the cushions against damage.

The invention is further explained by way of examples shown in the drawing, in which.

Figure 1:
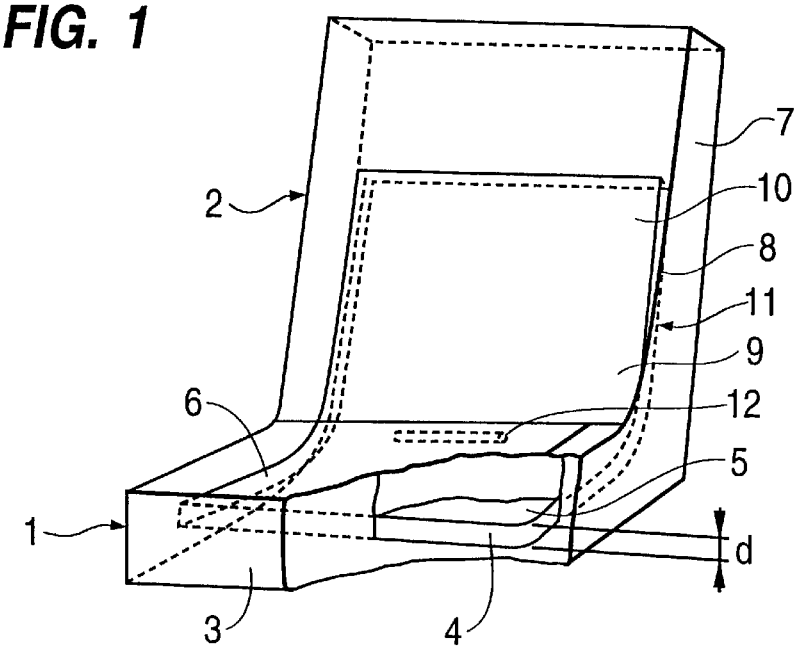
FIG. 1 shows diagrammatically a perspective view of a part of a chair according to the present invention, with a part of it being cut away.

The chair according to the invention, of which only the principal parts have been shown in FIG. 1, comprises the seat 1 and the back 2. The seat 1 rests on a frame portion not further indicated which in turn can be supported by legs. In the same way, the back 2 rests against a frame portion that can be connected with the first-mentioned frame portion.

The seat 1 comprises a first layer of foam rubber 3 in which a cavity 4 for receiving the cushion 5 has been formed. The cushion 5 is covered by a layer of foam rubber 10. Possibly, the layers of foam rubber 3, 6, 7 and 10 can be glued together.

Figure 2:
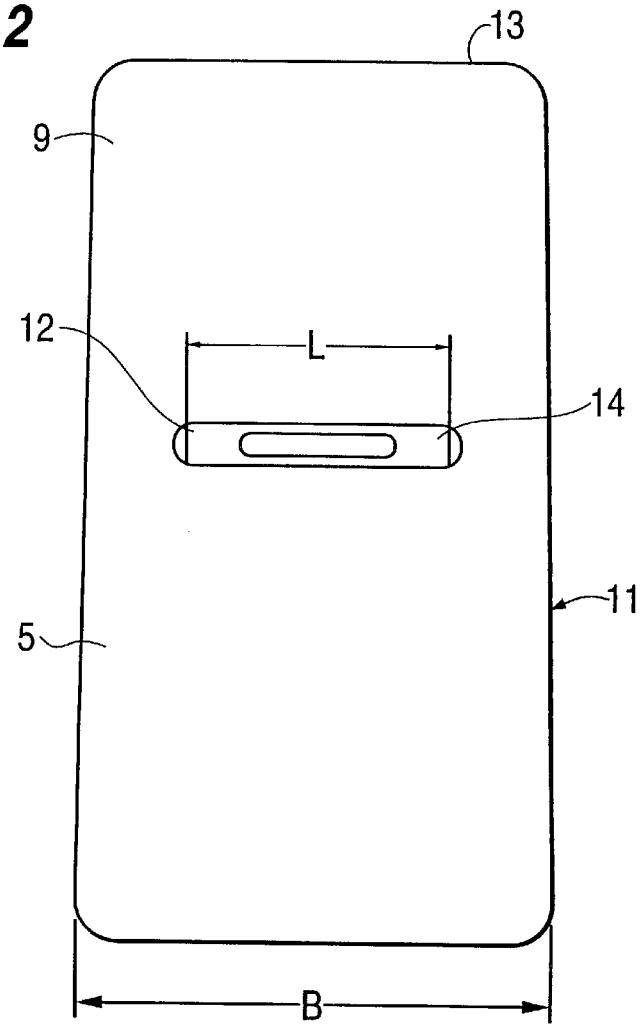
FIG. 2 shows a view of an integral cushion, applied with the chair of FIG. 1, in the folded-open condition.

FIG. 2 shows the cushions 5 and 9 being formed as a unity 11. At the point where the cushion 5 for the seat connects to the cushion 9 for the back, the cushion 11 is provided with a slot 12. In a known way, the cushion 11 is made from a suitable material such as a plastic sheet. Both layers of this material are attached to each other along the outer edges 13 and along the edge 14 of the slot 12, such as by means of sealing.

As stated above, the length L of the slot will be such, that it is 25 to 75% of the width B of the cushion. In particular, the length L will be 30 to 65% of the width B. The thickness d of the cushion will be from 20 to 80 mm.

An upholstery not further indicated, such as for example of furniture textile, will be applied around the layers of foam rubber.

Figure 3:
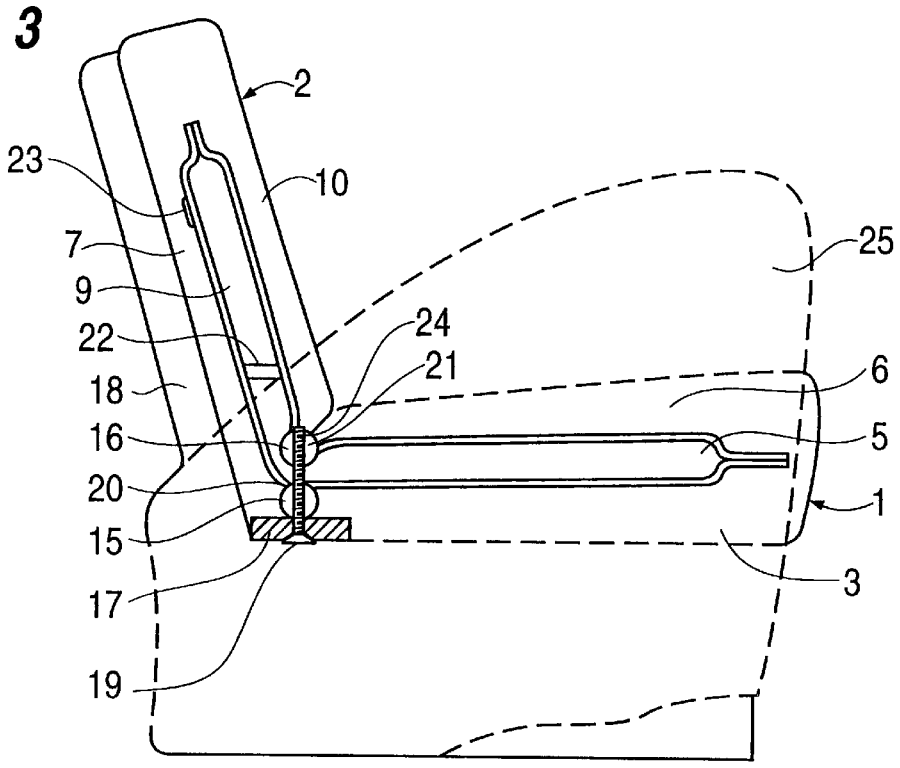
FIG. 3 shows diagrammatically, partly in cross-section and partly in side view, an armchair in which pressing members between both cushions have been employed.
Figure 4:
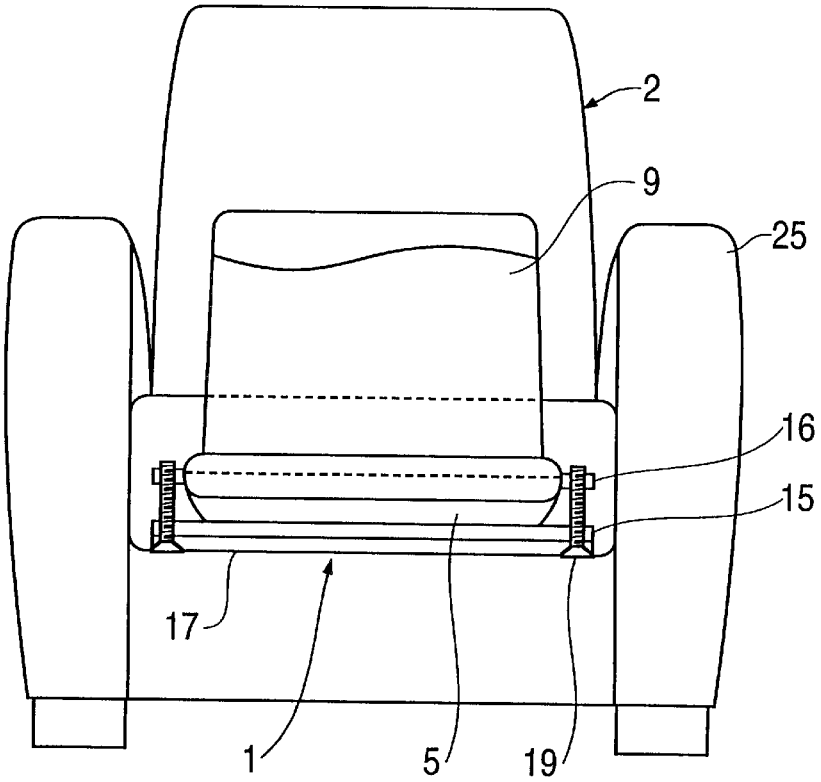
FIG. 4 shows diagrammatically a front view of the armchair of FIG. 3.

With the chair shown in the FIGS. 3 and 4, corresponding parts have been indicated with the same reference numbers as with the chair of the FIGS. 1 and 2. Here, both cushions 5 and 9 have again been executed as an integral unity 11 and at the point where the cushion 5 connects to the cushion 9, two pressure rollers 15 and 16 have been mounted. To that end, a cross beam 17 of the frame 18 holds a bolt 19 extending freely through a bore 20 in the roller and being screwed into a threaded hole 21 in the roller 16.

As appears in particular from FIG. 4, the bolts 19 are located on both sides of the cushion 11 so that they can not contact the cushion. By rotating the bolts 19, the roller 16 can be brought at the desired distance from the roller 15 for determining the flow of the water from the cushion 5 into the cushion 9 when a person sits down in the armchair. When the armchair is not in use, the water will be approximately at the level 22. The number 23 indicates a filler cap for filling the cushion with water.

As stated earlier with the chair according to the FIGS. 1 and 2, an upholstery such as of furniture textile can be applied across the layers of foam rubber covering the cushion 11. For example, this upholstery can be connected to the roller 16 along the line 24.

As shown in the FIGS. 3 and 4, the armchair is provided with armrests 25, which have been indicated with a dash line only in FIG. 3.

Figure 5:
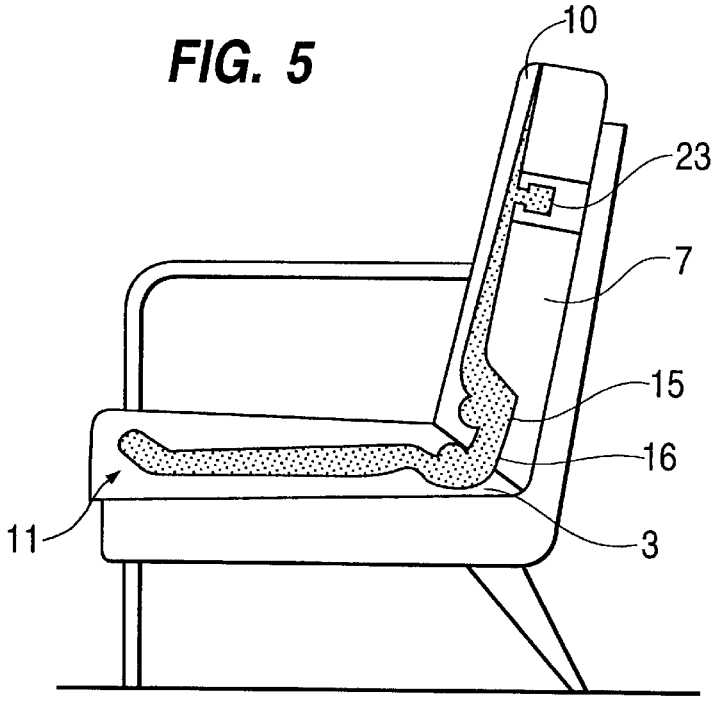
FIG. 5 shows diagrammatically, partly in cross-section and partly in side view, an armchair of an embodiment slightly modified in relation to FIG. 3.
Figure 6:
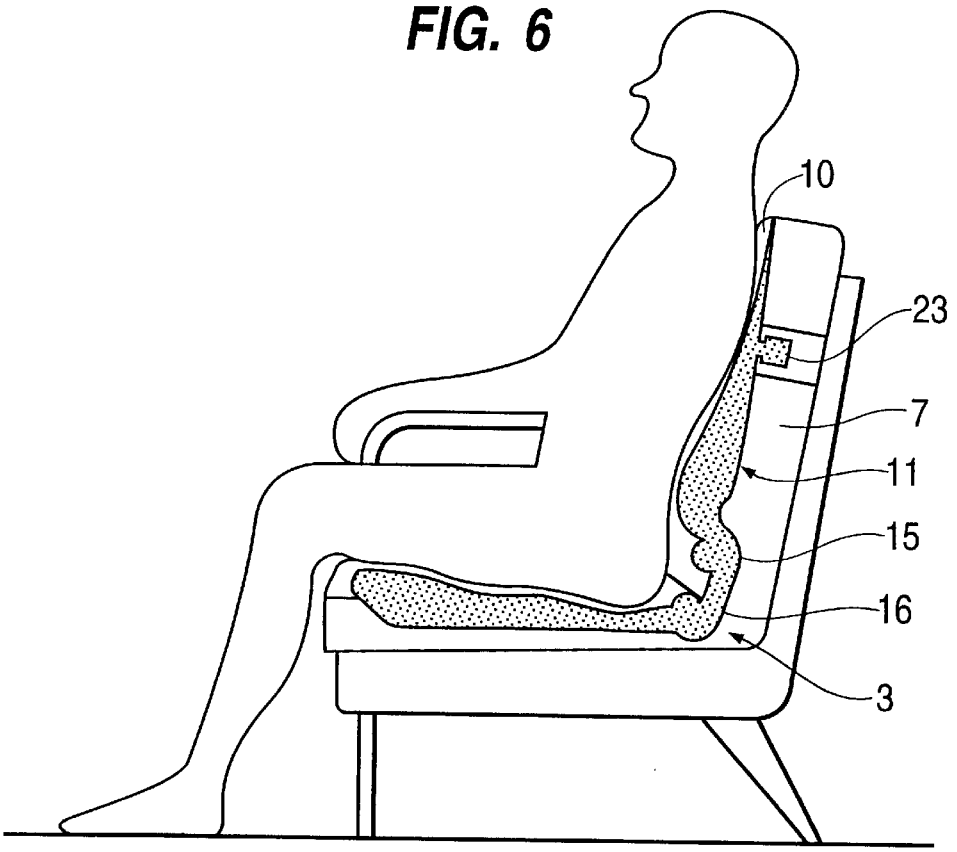
FIG. 6 shows the armchair of FIG. 5 when a person has come to sit in it.

FIGS. 5 and 6 show an armchair in which corresponding parts have again been indicated with the same reference numbers as with the embodiments discussed above.

With the FIGS. 5 and 6, two pressing members 15 and 16 are located at the same side of the cushion 11. The pressing members 15 and 16 press the cushion 11 against the layers 3 and/or 7 of foam rubber. This results in the effect, that the liquid can not flow quickly from the seat into the back.

It will be obvious, that only some possible embodiments of a chair or an armchair according to the invention have been illustrated in the drawing and described above, and that many changes can be made without leaving the scope of the invention. Naturally, the structure described can also be applied with a couch, in which each seat will then be provided with a separate cushion.

I claim:

1. Chair or armchair having a seat and a back, the chair or armchair comprising:

a cushion filled with water or a similar, non-compressible material, with a thickness between 20 and 80 mm when in filled condition, the cushion having an internal space in the seat and an internal space in the back being connected to each other by at least one channel through which water can flow from the internal space in the seat into the internal space in the back or vice versa, the at least one channel having a smaller cross-sectional area than a cross-sectional area of the internal spaces of the cushion connected by the at least one channel;

a first pressing member at a first end of the at least one channel proximate to the internal space in the seat; and a second pressing member at a second end of the at least one channel proximate to the internal space in the back.

2. Chair or armchair according to claim 1, wherein the internal spaces of the cushion form an integral unit, and the first and second pressing members are mounted between the internal spaces on one side of the cushion such that the cushion will be pressed against parts of the chair so as to limit passage through the at least one channel between both internal spaces.

3. Chair or armchair according to claim 1, wherein the internal spaces of the cushion are received between layers of resilient material such as foam rubber or like material.

4. Chair or armchair having a seat and a back being provided with a covering of a resilient material such as foam rubber or a similar material, the chair or armchair comprising:

a cushion filled with water or a similar, non-compressible material, with a thickness between 20 and 80 mm when in filled condition, the cushion having an internal space in the seat and an internal space in the back being connected to each other by at least one channel through which water can flow from the internal space in the seat into the internal space in the back or vice versa, the at least one channel having a smaller cross-sectional area than a cross-sectional area of the internal spaces of the cushion connected by the at least one channel; and pressing members forming the smaller cross-section area, said pressing members including surfaces abutting the cushions having a convex shape.

5. Chair or armchair having a seat and a back being provided with a covering of a resilient material such as foam rubber or a similar material, the chair or armchair comprising:

a cushion filled with water or a similar, non-compressible material, with a thickness between 20 and 80 mm when in filled condition, the cushion having an internal space in the seat and an internal space in the back being connected to each other by at least one channel through which water can flow from the internal space in the seat into the internal space in the back or vice versa, the at least one channel having a smaller cross-sectional area than a cross-sectional area of the internal spaces of the cushion connected by the at least one channel; and pressing members forming the smaller cross-section area, said pressing members being in the form of rollers.

6. Chair or armchair according to claim 5, characterized in that the rollers are supported in such a way, that the distance between the rollers is adjustable.

* * * * *